United States Patent [19]

Kato et al.

[11] Patent Number: 4,867,712

[45] Date of Patent: Sep. 19, 1989

[54] CONNECTOR

[75] Inventors: Tetsuo Kato; Tadahiro Sueyoshi; Masanori Tsuji; Yukio Ohta, all of Shizuoka, Japan

[73] Assignee: Yazaki Corporation, Tokyo, Japan

[21] Appl. No.: 236,436

[22] Filed: Aug. 25, 1988

[30] Foreign Application Priority Data

Aug. 26, 1987 [JP] Japan ..... 62-210146

[51] Int. Cl.[4] ..... H01R 13/426; H01R 13/428

[52] U.S. Cl. ..... 439/752; 439/744

[58] Field of Search ..... 439/599, 603, 744, 746, 439/752, 871–873

[56] References Cited

U.S. PATENT DOCUMENTS

| | | | |
|---|---|---|---|
| 3,487,355 | 12/1969 | Cairns . | |
| 3,501,736 | 3/1970 | Norris . | |
| 4,159,160 | 6/1979 | Plyler et al. . | |
| 4,319,799 | 3/1982 | Pearce | 439/752 X |
| 4,583,805 | 4/1986 | Mantlik . | |
| 4,660,915 | 4/1987 | Mantlik . | |
| 4,752,251 | 6/1988 | Kato et al. | 439/752 |

FOREIGN PATENT DOCUMENTS

| | | | |
|---|---|---|---|
| 1099800 | 4/1981 | Canada | 439/746 |
| 54-28625 | 9/1979 | Japan . | |
| 55-92284 | 6/1980 | Japan . | |
| 2081526 | 9/1984 | United Kingdom . | |

*Primary Examiner*—Eugene F. Desmond

*Attorney, Agent, or Firm*—Armstrong, Nikaido, Marmelstein, Kubovcik & Murray

[57] ABSTRACT

There is provided a new connector having an insulated housing formed with chamber means defined by an upper wall and a lower wall, a terminal adapted to be locked in said chamber means, opening means formed in said upper and lower walls to provide communication with said chamber means and insertion pin means to be inserted into said opening means for additional lock of said terminal with the chamber means. The improvement comprises an engaging portion formed in said terminal; provisional and main catch means provided in edges of said opening means in the upper and lower walls; provisional locking means and main locking means formed in a longitudinally spaced-apart relationship in said insertion pin means, said providional and main catch means and said provisional and main locking means cooperating such that said insertion pin means takes a provisional engagement position and a full engagement position; and an abutment provided in said insertion pin means intermediate said provisional and main locking means, said abutment being kept away from said chamber means in said provisional engagement position to allow the terminal to move axially within said chamber means, said abutment being adpated to be positioned rearwardly of said engaging portion of said terminal when pressed into said full engagement position after the terminal is fully inserted to be locked in said chamber means.

10 Claims, 6 Drawing Sheets

CONNECTOR

BACKGROUND OF THE INVENTION

The present invention relates to improvements in a connector in which the terminals have a double-engaging structure.

Terminals in a connector are usually secured therewithin by means of struck-out pieces integrally formed in the terminals, said struck-out pieces being engaged with the bottom wall of terminal holding chambers in an insulated housing. Alternatively, flexible engaging arms integrally formed from the ceiling of the holding chambers may be brought into engagement with shoulder portions or holes in electric contact portions of the terminals.

However, since the struck-out pieces and engaging arms are so small in size that they are subject to damage as male and female connectors are attached and detached repetitively, thus resulting in frequent slip-offs of the terminals or poor contact thereby.

Japanese Utility Model Publication No. 28625/1979 discloses a method in which through holes are formed in an insulated housing that holds terminals, insertion pins are inserted in the through holes, and side surfaces of the insertion pins are brought into engagement with shoulder steps in the electric contact portions of the terminals to ensure double engagement in cooperation with the escape-preventing means between said terminals and the holding chambers.

The conventional insertion pins for double-engaging the terminals are separately formed from the insulated housing; i.e., after the terminals are inserted in the holding chambers, the insertion pins are inserted in the through holes. However if it is after the terminals are inserted, it often happens that the insertion of pins is inadvertently omitted. Furthermore, the number of parts of the connector increases, and laborious work is required for controlling the inventory.

It is therefore desired from the standpoint of assembling operation and the control of inventory to provide a connector that can be handled as a one piece part with insertion pins for double-engagement of the terminals that is tentatively locked to the insulated housing, and that is capable of accomplishing main locking after the terminals are inserted.

SUMMARY OF THE INVENTION

The object of the present invention is to provide a connector that meets such requirements.

Accordingly, in a connector having an insulated housing formed with chamber means defined by an upper wall and a lower wall, a terminal adapted to be locked in said chamber means, opening means formed in said upper and lower walls to provide communication with said chamber means and insertion pin means to be inserted into said opening means for additional lock of said terminal within the chamber means: there is essentially provided the improvement comprising an engaging portion formed in said terminal; provisional and main catch means provided in edges of said opening means in the upper and lower walls; provisional locking means and main locking means formed in a longitudinally spaced-apart relationship in said insertion pin means, said provisional and main catch means and said provisional and main locking means cooperating such that said insertion pin means takes a provisional engagement position and a full engagement position; and an abutment provided in said insertion pin means intermediate said provisional and main locking means, said abutment being kept away from said chamber means in said provisional engagement position to allow the terminal to move axially within said chamber means, said abutment being adapted to be positioned rearwardly of said engaging portion of said terminal when pressed into said full engagement position after the terminal is fully inserted to be locked in said chamber means.

DETAILED DESCRIPTION OF THE EMBODIMENT

Figure 1:
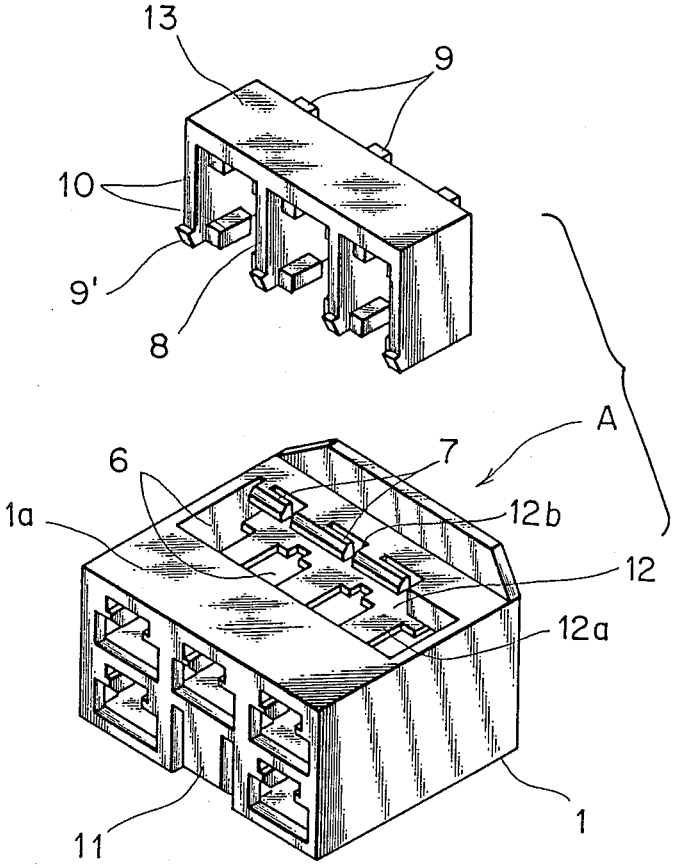
FIG. 1 is a perspective view which illustrates a connector of the present invention in a disassembled manner.
Figure 2:
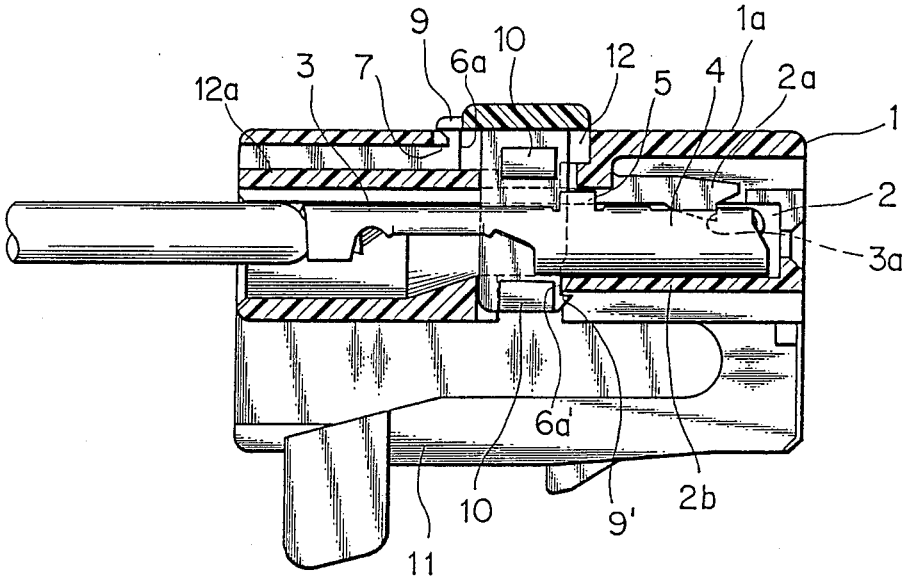
FIG. 2 is a sectioned view illustrating the state where the insertion pins of the connector of FIG. 1 are tentatively locked.
Figure 4:
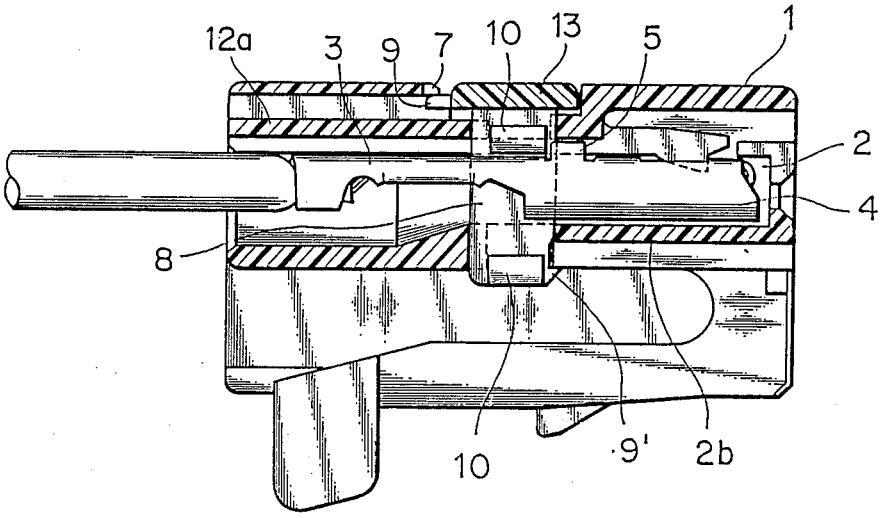
FIG. 4 is a sectional view illustrating the state where the insertion pins of the connector are fully locked.
Figure 3:
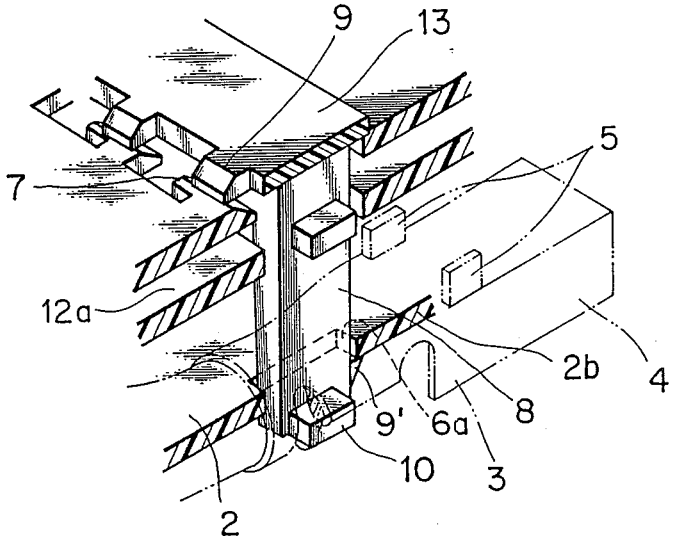
FIG. 3 is a cut-away perspective view showing major portions of FIG. 2.

In FIGS. 1 through 5, the present invention deals with a connector A in which primary locking means 2*a*, 3*a* are respectively provided in a terminal holding chambers 2 of an insulated housing 1 and terminals 3 (FIG. 2), openings 6 are formed in the upper and lower walls 1*a* and 2*b* of the insulated housing 1 to be communicated with the terminal holding chambers 2 (FIG. 1), and insertion pins 8 inserted in two steps, into said openings 6 are engaged with the terminals 3 to prevent said terminals from escaping, wherein, said terminals 3 are provided with engaging portions 5 (FIGS. 3 and 5), said insulated housing 1 is provided with a catch piece 7 at the rearward edge of said opening 6 in the upper wall 1*a*, said insertion pins 8 are rigidly provided with main locking pieces 9 at their upper end portions, with provisional locking pieces 9' at their lower end portions and with engaging protuberances 10 on the intermediate side wall thereof each to act as an abutment. In FIGS. 3 and 4, a plurality of the terminals 3 are supposed to be inserted into a generally double-stage housing structure but only a lower stage terminal 3 is illustrated because the omission of an upper stage terminal makes the inner arrangement of the elements clearer. What is to be noted, however, the operation of the invention is described on the basis of said upper stage terminal hereinafter. When said insertion pins 8 are positioned in the provisional engagement position due to the engagement of said provisional locking pieces 9' with the forward edges 6a' of said opening 6 in said in the lower wall 2b, said engaging protuberances 10 are separated away from said terminal retaining chamber 2 so that said terminals 3 can be inserted or removed. When said insertion pins 8 are brought into the main locking position due to the engagement of said main locking pieces 9 with said catch pieces 7, said engaging protuberances 10 protrude into said terminal holding chambers 2 and engage with the engaging portions 5 of said terminals 3 so that said terminals 3 are prevented from rearward movement.

In the aforementioned constitution, the connector A is constructed in the form of a male connector with six poles, the forewardmost wall of the insulated housing 1 is provided with locking arms 11 for connection with the female connector (not shown), and six terminal retaining chambers 2 arranged in upper and lower two stages in parallel accommodate female-type terminals 3 having electric contact portions 4 of a cylindrical shape for receiving tabs of the counterparts. The flexible engaging arms 2a protruded from the upper wall of the terminal retaining chambers 2 as a unitary structure and the engaging holes 3a formed in the upper wall of the electric contacts 4 of the terminals 3, constitute engaging means 2a, 3a for engaging them together. The engaging portions 5 are cut out upward from the upper wall of the electric contacts 4 at the rear sides thereof as a unitary structure.

Recessed portions 12 are formed in the outer peripheral wall 1a on the side opposite to the locking arms 11 of the insulated housing 1, the openings 6 are formed in the bottom wall 12a of the recessed portions 12, and the L-shaped catch pieces 7, that face the rearward edges of the openings 6, extend from the side walls 12b of the recessed portions 12 toward a direction to meet at right angles with the axial direction of the terminal holding chambers 2, the catch pieces 7 having flexibility to undergo elastic deflection in the upward and downward directions.

The insertion pins 8 assume the shape of a plate with their heads being formed like comb teeth coupled by coupling plate 13, each corresponding to the terminal holding chambers 2 that are arranged in parallel. Each of the insertion pins 8 is provided with a rigid main locking piece 9 at the upper end portion thereof, a provisional locking piece 9' at the lower end portion thereof and engaging protuberances 10 in upper and lower stages on the intermediate side wall thereof to engage with the engaging portion 5 of each terminal 3.

In the foregoing was described the case of the male connector for retaining the female-type terminals therein 3. The present invention, however, can also be adapted in the same manner even to the case of the female connector for retaining the male-type terminals therein. Further, either the catch pieces 7 or the main locking pieces 9 may have flexibility, and where the provisional locking pieces 9' are formed as small self-locking pawls or short flexible pins as shown.

According to the present invention, the insertion pins 8 are inserted into the openings 6 as shown in FIGS. 2 and 3, whereby the main locking pieces 9 come into contact with the catch piece 7 to slightly deflect the catch pieces 7 downwards while the provisional locking pieces 9' come into engagement with the edges 6a' of through holes 6, that is edges 6a' of a partitioning wall 2b between the upper and lower terminal retaining chambers 2 and 2 in FIGS. 2 and 4, such that the insertion pins 8 are provisionally locked.

When the insertion pins 8 are located at the provisional locking position as described above, the engaging protuberances 10 are positioned away from the interior of each terminal retaining chambers 2 enabling the terminals 3 to be freely inserted or removed.

Figure 5:
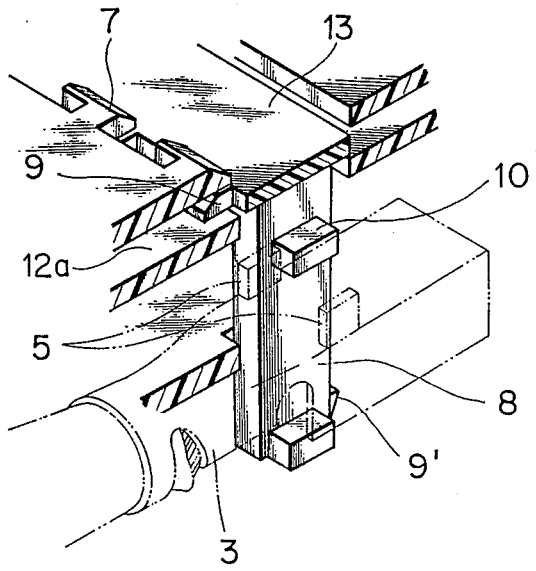
FIG. 5 is a cut-away perspective view showing major portions of FIG. 4.

Then the terminals 3 are completely inserted and are primarily engaged by the engaging means 2a, 3a. Thereafter, the insertion pins 8 are pushed again as shown in FIGS. 4 and 5, whereby the main locking pieces 9 further pushes the catch pieces 7 to snap over the same and enter into space between said catch pieces 7 and the bottom wall 12a of the recessed portion 12 such that the insertion pins 8 are locked.

In this lock position, the engaging protuberances 10 take the descend position to protrude into the terminal retaining chambers 2, and are located rearwardly of the engaging portions 5 of the terminals 3 to engage therewith. Therefore, the terminals 3 are prevented from moving rearwardly, i.e., prevented from slipping off from the housing in cooperation with the above-mentioned engaging means 2a and 3a to realize a two-step engagement. Here, such engaging portions 5 need not be cut out upward in the terminals 3, but the engaging protuberances 10 may be brought into engagement with the shoulder portions of the electric contacts 4 or with the rear edge of electric wire connecting portions of the terminals 3.

In FIGS. 6 through 10, there is shown another embodiment of the present invention. Since the general structure of the connector, the terminal housed therein and the insertion pins are basically the same as the foregoing embodiment, like numerals and characters will be used to indicate like members and elements.

Figure 6:
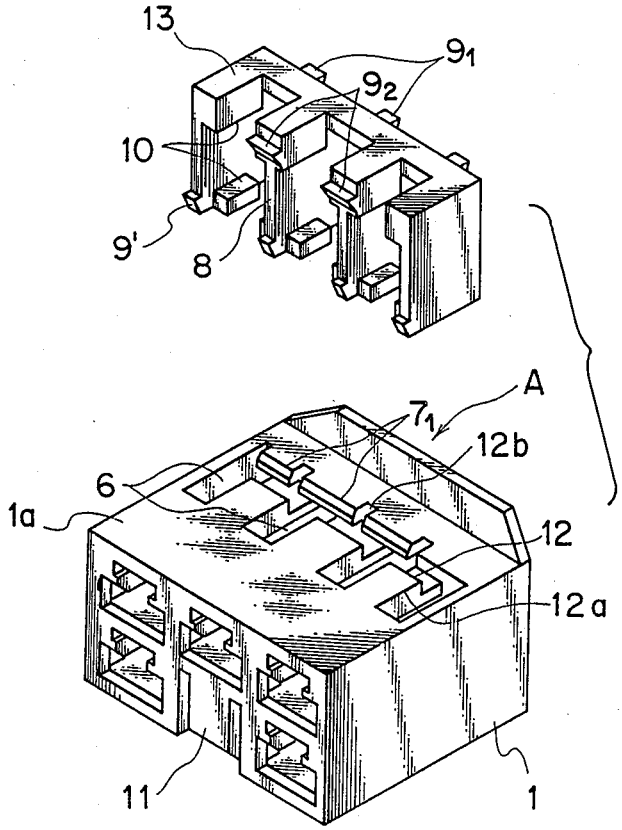
FIG. 6 is a perspective view of another embodiment of the present invention illustrating a connector in a disassembled manner.
Figure 7:
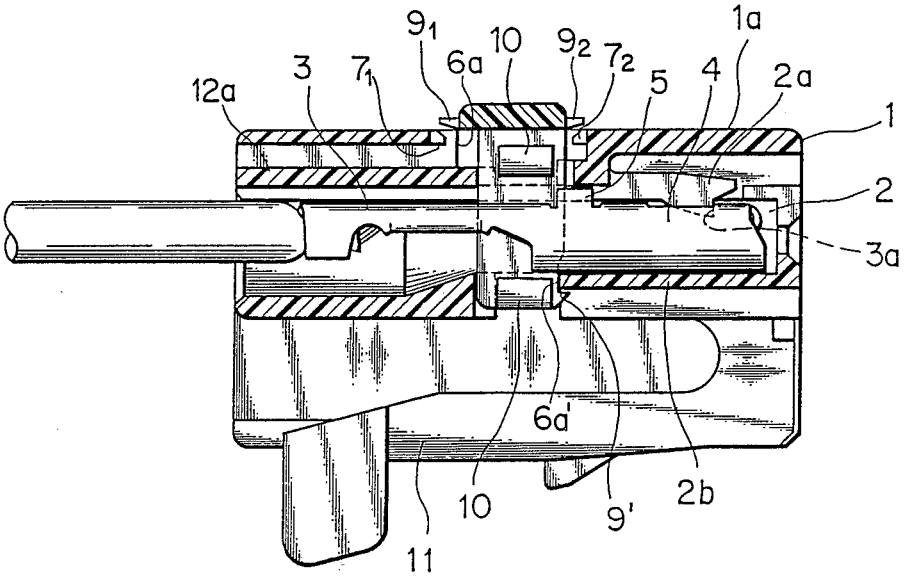
FIG. 7 is a sectional view illustrating the state where the insertion pins of the connector of FIG. 6 are tentatively locked within the housing.
Figure 9:
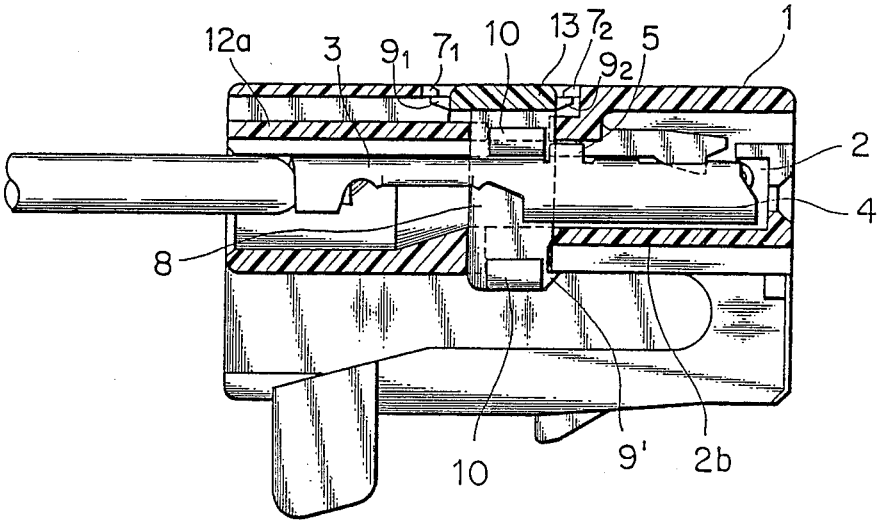
FIG. 9 is a sectional view illustrating the state where the insertion pins of the connector of FIG. 6 are fully locked within the housing.
Figure 8:
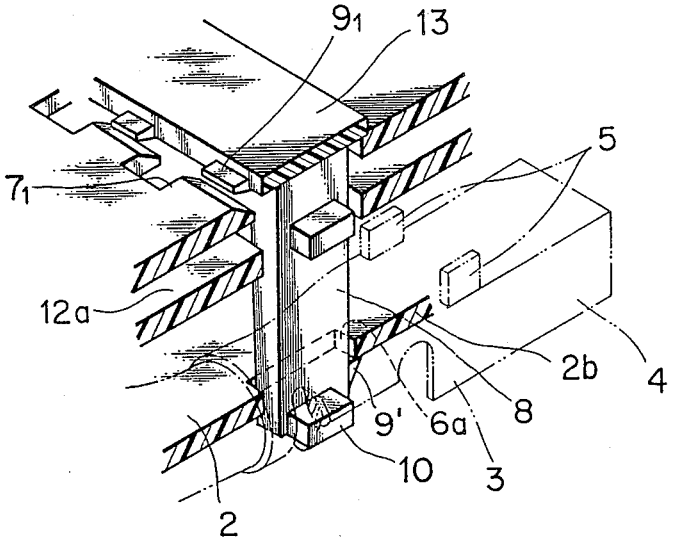
FIG. 8 is a cut-away perspective view showing major portions of FIG. 7.
Figure 10:
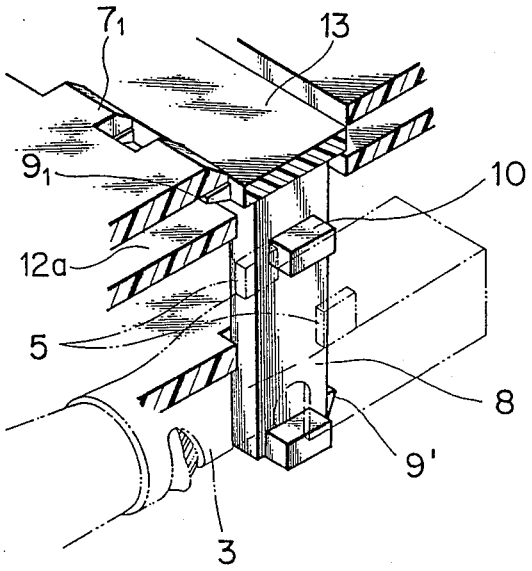
FIG. 10 is a cut-away perspective view showing major portions of FIG. 9.

The connector A perspectively shown in FIG. 6 has a similar structure except in that there are resiliently provided a first main catch piece $7_1$ and a second main catch piece $7_2$ in the respective rearward and forward edges of the opening 6 when viewed along with FIGS. 7 and 9 while a first main locking piece $9_1$ and a second main locking piece $9_2$ are rigidly provided in the respective rearward upper portion and forward upper portion of the each insertion pin 8. Each of said first and second main locking pieces $9_1$ and $9_2$ is defined by a flat upper surface and a sloping lower surface as best shown in FIGS. 6, 7 and 9.

There are provided in the form of multiple row arrangement in the rearward edge of the opening 6 a plurality of laterally elongate resilient catch pieces $7_1$ each connected to said rearward edge of the opening in the upper wall la along the entire length thereof. Unlike the L-shaped catch pieces 7 in the foregoing embodiment, the catch pieces $7_1$ of this embodiment are made less resilient.

A plurality of insertion pins 8 are connected by a vertical wall 8' to provide a comb teeth like configuration. The forward edge of the opening 6 in the upper and lower walls has a configuration complementary to the comb teeth configuration of the insertion pin assembly. With the above structure, the operation of this embodiment is practically the same as the previous embodiment and self-explanary.

Using the connector of the present invention as described in the foregoing, the insertion pins are provisionally locked to the insulated housing under the condition where the terminals can be inserted in or removed from the terminal retaining chambers. Therefore, the connector can be handled as a one-piece part, the insertion pins are never left without insertion after the terminals have been inserted, the operation efficiency for assembling the connectors is improved, and the labor for controlling the inventory can be halved. With the insertion pins being arranged in large number like a chain, furthermore, the insertion pins can be used by cutting the chain at a suitable position that meets the number of poles of the connector, obviating the need of manufacturing the insertion pins in a variety of kinds.

What is claimed is:

1. In a connector having an insulated housing formed with chamber means defined by an upper wall and a lower wall, a terminal adapted to be locked in said chamber means, opening means formed in said upper and lower walls to provide communication with said chamber means and insertion pin means to be inserted into said opening means for additional lock of said terminal within the chamber means: the improvement comprising an engaging portion formed in a terminal; provisional and main catch means provided in edges of said opening means in the upper and lower walls; provisional locking means and main locking means formed in a longitudinally spaced-apart relationship in said insertion pin means, said provisional and main catch means and said provisional and main locking means cooperating such that said insertion pin means takes a provisional engagement position and a full engagement position; and an abutment provided in said insertion pin means intermediate said provisional and main locking means, said abutment being kept away from said chamber means in said provisional engagement position to allow the terminal to move axially within said chamber means, said abutment being adapted to be positioned rearwardly of said engaging portion of said terminal when pressed into said full engagement position after the terminals are fully inserted to be locked in said chamber means.

2. A connector according to claim 1, wherein said provisional and main catch means includes a provisional catch piece formed in a forward edge of said opening means in the lower wall and a resilient main catch piece formed in a rearward edge of said opening means in the upper wall, said provisional locking means including a wedge-shaped projection formed in a lower portion of said insertion pin means to project forwardly, said main locking means being rigidly formed in an upper portion of said insertion pin means to project rearwardly.

3. A connector according to claim 1, wherein said chamber means includes a plurality of chambers arranged in two stages and in a plurality of rows in each stage.

4. A connector according to claim 1, wherein said insertion pin means includes a plurality of insertion pins connected in comb teeth fashion.

5. A connector according to claim 2, wherein said resilient main catch piece includes an L-shaped member having one of two arms thereof connected to the rearward edge of the opening means in the upper wall.

6. A connector according to claim 1, wherein said provisional and main catch means includes a provisional catch piece formed in a forward edge of said opening means in the lower wall of the housing, a first main catch piece resiliently formed in a rearward edge of said opening means in the upper wall and a second main catch piece formed in a forward edge of said opening means in the upper wall, said provisional locking means of the insertion pin means including a wedge-shaped projection formed in a lower portion of said insertion pin means to project forwardly, said main locking means of the insertion pin means including a first main locking piece rigidly formed in an upper rearward portion of said insertion pin means and a second main locking piece rigidly formed in an upper forward portion of said insertion pin means.

7. A connector according to claim 6, wherein each of said first and second main locking pieces is defined by a flat upper surface and sloping lower surface.

8. A connector according to any one of claims 6 and 7, wherein said resilient first main catch piece include a laterally elongate member connected to the rearward edge of the opening means in the upper wall along an entire length thereof.

9. A connector according to claim 6, wherein said insertion pin means includes a plurality of insertion pins connected in comb teeth fashion.

10. A connector according to claim 9, wherein said forward edge of said opening means has a configuration complementary to said comb teeth configuration of the insertion pin means.

* * * * *